US005923308A

United States Patent [19]

Wei et al.

[11] Patent Number: 5,923,308

[45] Date of Patent: Jul. 13, 1999

[54] ARRAY OF LEDS WITH ACTIVE PULL DOWN SHADOW CANCELING CIRCUITRY

[75] Inventors: Cheng-Ping Wei, Gilbert; Michael P. Norman, Chandler; Matthew Kim, Scottsdale, all of Ariz.

[73] Assignee: Motorola, Inc., Schaumburg, Ill.

[21] Appl. No.: 08/746,513

[22] Filed: Nov. 12, 1996

[51] Int. Cl.[6] ..... G09G 3/06

[52] U.S. Cl. ..... 345/44; 345/45; 345/46; 345/76; 345/82

[58] Field of Search ..... 345/44–46, 76–78, 345/80, 82–83

[56] References Cited

U.S. PATENT DOCUMENTS

| | | | |
|---|---|---|---|
| 4,247,854 | 1/1981 | Carpenter et al. | 345/42 |
| 4,866,348 | 9/1989 | Harada et al. | 315/169.3 |
| 4,882,577 | 11/1989 | DeVore | 345/12 |
| 5,250,931 | 10/1993 | Misawa et al. | 345/206 |
| 5,493,317 | 2/1996 | Kim | 345/213 |
| 5,679,960 | 10/1997 | Akama | 257/10 |
| 5,684,365 | 11/1997 | Tang et al. | 315/169.3 |
| 5,688,551 | 11/1997 | Littman et al. | 427/64 |

*Primary Examiner*—Amare Mengistu
*Assistant Examiner*—Ricardo Osorio
*Attorney, Agent, or Firm*—Eugene A. Parsons; William E. Koch

[57] ABSTRACT

An array of OEDs is arranged in rows and columns with a plurality of row buses and a plurality of column buses. Each of the OEDs has a first terminal coupled to an associated row bus and a second terminal coupled to an associated column bus. A switching circuit is connected to a shadow canceling row bus of the plurality of row buses. The switching circuit is constructed to receive a shadow canceling signal on a terminal thereof and to connect the shadow canceling row bus to a pull down potential in response to the shadow canceling signal, whereby all of the OEDs in the array, other than those associated with the shadow canceling row bus, are coupled to the pull down potential and discharged.

7 Claims, 1 Drawing Sheet

ARRAY OF LEDS WITH ACTIVE PULL DOWN SHADOW CANCELING CIRCUITRY

FIELD OF THE INVENTION

The present invention pertains to arrays of light emitting devices and more specifically to shadow canceling in arrays of light emitting devices.

BACKGROUND OF THE INVENTION

Arrays of light emitting devices, such as inorganic light emitting diodes, organic light emitting diodes or electroluminescent devices, etc., are becoming increasingly popular in displays. This popularity is chiefly due to the low operating voltages and power required and to the small size, as well as the ease of manufacturing. This is especially true of organic electroluminescent devices (OEDs), since manufacturing is even easier than many other light emitting devices, the brightness is even greater, and the voltage requirements are substantially less.

The problem is that most of the light emitting devices have an internal capacitance which charges during operation and remains charged after activation of the device. This lingering or persisting charge produces what is commonly referred to as shadows in the display, because the charge remaining from a previous row of data will continue to produce light emissions that appear in the next row of data and, in some circuits, may effect the next row of data. Because OEDs include a layer of organic material, which is nearly a dielectric, sandwiched between layers of conducting material, the internal capacitance is relatively large. Thus the shadow problem is especially prevalent in arrays of OEDs.

Accordingly, it would be highly desirable to produce an array of light emitting diodes in which no shadow is prevalent.

It is a purpose of the present invention to provide a new and improved array of light emitting devices with active pull down shadow canceling.

It is another purpose of the present invention to provide a new and improved array of light emitting devices with active pull down shadow canceling which adds very little complexity to the array.

It is still another purpose of the present invention to provide a new and improved array of light emitting devices with active pull down shadow canceling which is relatively simple and inexpensive to manufacture.

It is a further purpose of the present invention to provide a new and improved array of light emitting devices with active pull down shadow canceling in which the drivers are simplified and, thereby, cost is reduced.

It is a still further purpose of the present invention to provide a new and improved array of light emitting devices with active pull down shadow canceling which is easily integrated on a common substrate with little additional cost and effort.

SUMMARY OF THE INVENTION

The above problems and others are at least partially solved and the above purposes and others are realized in an array of light emitting devices, which in the preferred embodiment are organic electroluminescent devices (OEDs), arranged in rows and columns with a plurality of row buses and a plurality of column buses. Each of the OEDs has a first terminal coupled to an associated row bus and a second terminal coupled to an associated column bus. A switching circuit is connected to a shadow canceling row bus of the plurality of row buses. The switching circuit is constructed to receive a shadow canceling signal on a terminal thereof and to connect the shadow canceling row bus to a pull down potential in response to the shadow canceling signal, whereby all of the OEDs in the array, other than those associated with the shadow canceling row bus, are coupled to the pull down potential and discharged. Generally, a shadow canceling signal is applied to the switching circuit after each complete row of data applied to the array of OEDs.

BRIEF DESCRIPTION OF THE DRAWINGS

Referring to the drawings.

DESCRIPTION OF THE PREFERRED EMBODIMENT

Figure 1:
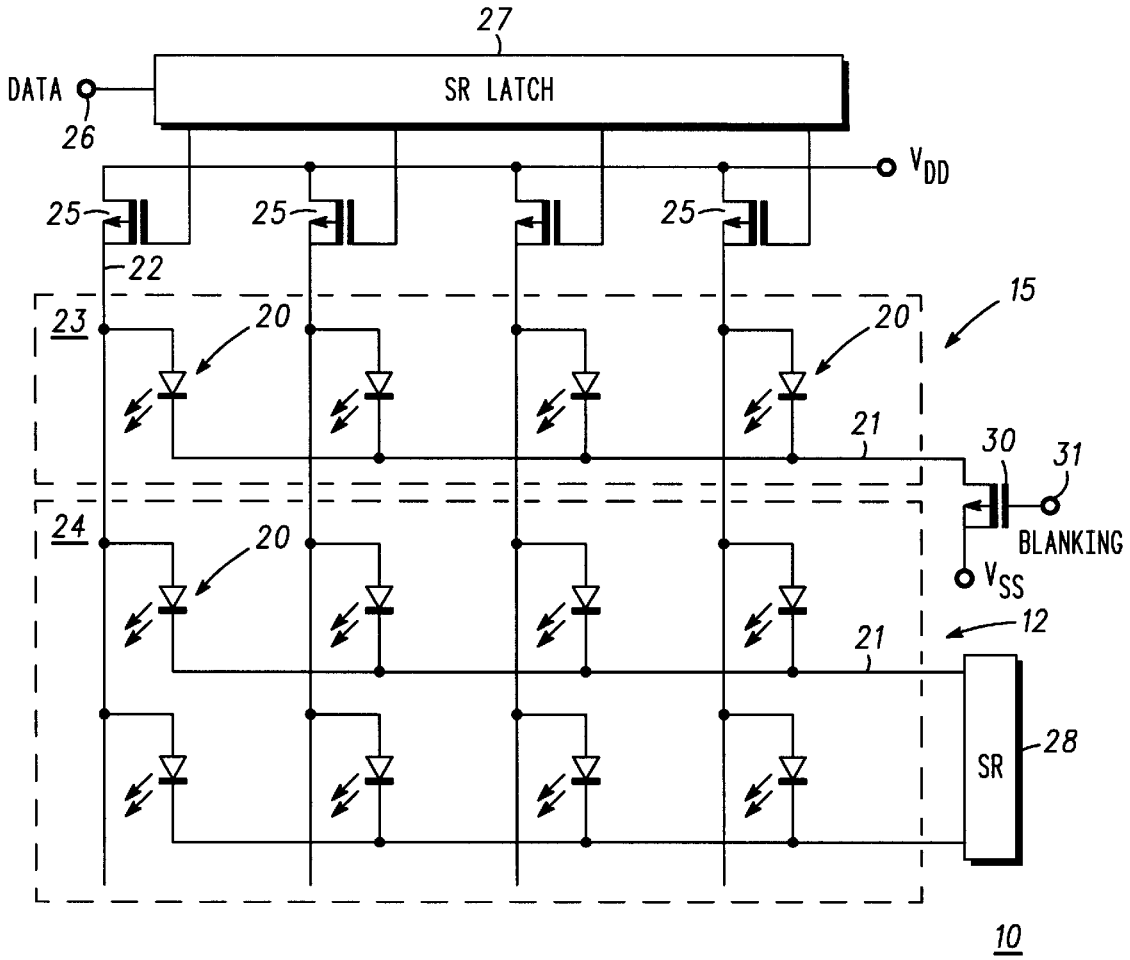
FIG. 1 is a simplified schematic diagram of a display including an array of light emitting devices and incorporating shadow canceling circuitry in accordance with the present invention.

A simplified schematic diagram of a display 10 is illustrated in FIG. 1, including an array 12 of light emitting devices and incorporating shadow canceling circuitry 15 in accordance with the present invention. While it will be understood that array 12 may include virtually any light emitting devices which include internal capacitance and, therefore, have a shadow problem, in this specific example the light emitting devices are described as organic electroluminescent devices (OEDs) because the shadow problem is especially prevalent in this type of device.

Array 12 includes a plurality of OEDs 20 arranged in rows and columns with a plurality of row buses 21 and a plurality of column buses 22. A first terminal, which in this specific example is the cathode, of each OED 20 is coupled to an associated row bus 21 and a second terminal, which in this specific example is the anode, of each OED 20 is coupled to an associated column bus 22. Thus, each OED 20 is connected to an intersection of a specific row 21 and column 22 so that each OED 20 has a unique row-column address and may be individually addressed to supply data thereto in a well known manner.

Array 12 is divided into two components, a single row 23 of OEDs 20, hereinafter referred to as shadow canceling row 23, and the remaining rows, herein designated a main display array 24. While shadow canceling row 23 is illustrated as the upper row of array 12, it will be understood from the following explanation that it could be the lower row or any intermediate row, if desired. Further, the terms "row" and "column" used throughout this disclosure are only for purposes of this explanation and it will be apparent that the terms are interchangeable.

While it will be understood that a variety of addressing and data supplying schemes can be utilized, in this example a column driver 25 is connected to each column bus. Each column driver 25 is a switching circuit, in this case a transistor, having a first current carrying terminal (e.g. a drain) connected to a voltage supply $V_{DD}$, a second current carrying terminal (e.g. a source) connected to an associated column bus 22, and a control terminal (e.g. a gate) connected to a column periodic switching circuit, which in this example is a shift register 27. Shift register 27 periodically cycles through, or connects, each column driver 25 to voltage supply $V_{DD}$ in accordance with data supplied to a data input terminal 26.

A row periodic switching circuit, which in this example is a shift register 28, periodically cycles through, or connects an activating signal to each row bus 21 of main display array 24. Shift registers 27 and 28 are timed and synchronized so that each driver 25 is accessed by a signal from shift register 27 for each row bus 21 of main display array 24 accessed by shift register 28. A complete frame is defined as a complete cycle of row buses 21 in main display array 24 and a complete cycle of column buses 22 for each row bus 21 accessed. In some scanning schemes, inactive rows (i.e. rows in which no OED is active, or a row of data containing all zeros) are skipped and a frame of data in these schemes is still one in which a cycle of row buses is completed.

Switching circuit 15, in this specific embodiment includes a transistor 30 having a first current carrying terminal (e.g. a drain) connected to row bus 21 of shadow canceling row 23, a second current carrying terminal (e.g. a source) connected to a pull down potential (designated Vss), and a control electrode (e.g. a gate) connected to a terminal 31 and adapted to have a shadow canceling or blanking signal applied thereto. In this example, transistor 30 is a thin film transistor (TFT) which is integrated, along with drivers 25, which are also thin film transistors, on a common substrate with array 12. Thus, when a positive signal is applied to the control electrode of transistor 30, row bus 21 of shadow canceling row 23 is connected to the pull down potential. The anode of each OED 20 in main display array 24 is connected to the anode of one of the OEDs 20 in shadow canceling row 23 by way of one of column buses 22. The pull down potential Vss is chosen such that any charge retained on each OED 20 in main display array 24 is discharged through the connected anode of the OEDs 20 in shadow canceling row 23 while the pull down potential is being applied to the control electrode of transistor 30. Thus, all OEDs 20 in the entire main display array 24 are discharged each time the pull down potential is being applied. It will of course be understood that shadow canceling row 23 will normally be covered so that any light emission which occurs during the discharge period will not interfere with the display or otherwise cause objectionable emissions.

Figure 2:
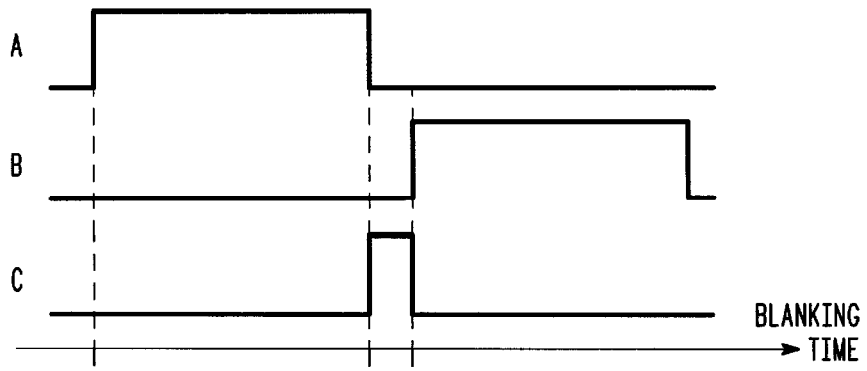
FIG. 2 illustrates several waveforms utilized in the array of light emitting devices illustrated in FIG. 1.

Turning now to FIG. 2 and viewing it in conjunction with the apparatus of FIG. 1, the operation of the display 10 is generally as follows. Assume, for purposes of this explanation, that array 12 includes 32 rows and 64 columns, and the first row is the shadow canceling row while the remaining 31 rows are the main display array. Then a complete row is 64 OEDs 20. Again it should be understood that each of the 64 OEDs 20 in the row may not actually be accessed, or scanned, if it is inactive. A timing diagram is illustrated in FIG. 2, in which a first row is represented by a rectangular wave illustrated in waveform A and extending from time $t_1$ to time $t_2$. A second row is represented by a rectangular wave illustrated in waveform B and extending from time $t_3$ to time $t_4$. The first and second rows are separated in time by a discharge period, extending from time $t_2$ to time $t_3$, during which time a blanking pulse, illustrated in waveform C. is applied to the control electrode of transistor 30.

Thus, a complete row of data is applied to main display array 24 during time $t_1$ to time $t_2$ to produce a line of a desired image. A blanking pulse is applied to the control electrode of transistor 30 during time $t_2$ to time $t_3$ to completely discharge any remaining charge in OEDs 20. Another complete row of data is then applied to main display array 24 during time $t_3$ to time $t_4$ to produce another complete line of the desired image. Because all OEDs 20 in main display array 24 are discharged after each frame, shadows are virtually completely eliminated from the display. Also, any remaining charge will not effect charges supplied to the next row of OEDs. It will of course be understood that supplying a shadow canceling signal to switching circuit 15 after each row is considered optimum but it may be desirable in some applications to provide the shadow canceling signals more or less often, e.g. after each frame, etc.

Accordingly, an array of light emitting diodes in which no shadow is prevalent has been disclosed. A new and improved array of light emitting devices with active pull down shadow canceling is disclosed which adds very little complexity to the array because shadow canceling row 23 is fabricated as an integral row of array 12, although an additional row can be added for this purpose if desired. Further, switching circuit 15 is integrated along with drivers 25 so that virtually no additional chip real estate or additional labor is involved. Further because the blanking is not a portion of the driver circuitry, or the drivers are not relied upon for the blanking feature, the entire assembly 10 is relatively simple and inexpensive to manufacture and the drivers are simplified and, thereby, cost is reduced. Also, since shadow canceling row 23 is fabricated as an integral row of array 12 and switching circuit 15 is integrated along with drivers 25, assembly 10 is easily integrated on a common substrate with little additional cost and effort.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. An array of light emitting devices with active pull down shadow canceling circuitry comprising:

a plurality of organic light emitting devices arranged in rows and columns with a plurality of row buses and a plurality of column buses, a first terminal of each of the light emitting devices being coupled to an associated row bus and a second terminal of each of the light emitting devices being coupled to an associated column bus; and a switching circuit connected to a row bus of one of the plurality of row buses, the switching circuit responsive to a shadow canceling signal for coupling the row bus to a pull down potential in response to the shadow canceling signal, wherein the switching circuit includes a first current carrying terminal connected to the row bus, a second current carrying terminal connected to the pull down potential and a control terminal connected to receive the shadow canceling signal, the organic light emitting devices in the row connected to the switching circuit providing a low impedance for discharging the remaining rows.

2. An array of light emitting devices with active pull down shadow canceling circuitry as claimed in claim 1 including in addition a plurality of column drivers, one column driver connected to each column bus of the array.

3. An array of light emitting devices with active pull down shadow canceling circuitry comprising:

an array of light emitting devices arranged in rows and columns with a plurality of row buses and a plurality of column buses, a first terminal of each of the light emitting devices being coupled to an associated row bus and a second terminal of each of the light emitting devices being coupled to an associated column bus; and a switching circuit connected to a row bus of the plurality of row buses, the switching circuit being constructed to receive a shadow canceling signal on a terminal thereof and to connect the row bus to a pull down potential in response to the shadow canceling signal, wherein the switching circuit includes a transistor having a first current carrying terminal connected to the row bus, a second current carrying terminal connected to the pull down potential and a control terminal connected to receive the shadow canceling signal.

4. An array of light emitting devices with active pull down shadow canceling circuitry as claimed in claim 3 wherein the transistor is a thin film transistor integrated on a substrate with the array.

5. An array of light emitting devices with active pull down shadow canceling circuitry comprising:

an array of organic electroluminescent devices arranged in rows and columns with a plurality of row buses and a plurality of column buses, a first terminal of each of the light emitting devices being connected to an associated row bus and a second terminal of each of the light emitting devices being connected to an associated column bus;

a plurality of column drivers, one column driver connected to each column bus of the array; and a switching transistor connected to a shadow canceling row bus of the plurality of row buses, the switching transistor having a first current carrying terminal connected to the shadow canceling row bus, a control terminal connected to receive a shadow canceling signal thereon, and a second current carrying terminal connected to a pull down potential, whereby the second terminal of all organic electroluminescent devices in the array, other than those in the shadow canceling row, are coupled to the pull down potential and discharged in response to the shadow canceling signal.

6. An array of light emitting devices with active pull down shadow canceling circuitry as claimed in claim 5 wherein light emitting devices having a first terminal coupled to the shadow canceling row bus are covered to prevent light emission.

7. An array of light emitting devices with active pull down shadow canceling circuitry as claimed in claim 5 wherein the plurality of column drivers and the switching transistor are integrated on a common substrate with the array of organic electroluminescent devices.

* * * * *